US005121938A

United States Patent [19]

Gross et al.

[11] Patent Number: 5,121,938

[45] Date of Patent: Jun. 16, 1992

[54] SLIP COVERS FOR WHEELCHAIRS

[75] Inventors: Debra S. Gross, North Ridgeville; Marilyn Carstensen, Amherst, both of Ohio

[73] Assignee: Invacare Corporation, Elyria, Ohio

[21] Appl. No.: 664,100

[22] Filed: Mar. 4, 1991

[51] Int. Cl.[5] ..... A47C 27/00

[52] U.S. Cl. ..... 280/304.1; 297/219; 297/DIG. 6

[58] Field of Search ..... 280/304.1, 250.1, 770; 297/219, 224, 225, DIG. 4, DIG. 6

[56] References Cited

U.S. PATENT DOCUMENTS

| | | | |
|---|---|---|---|
| Re. 32,242 | 9/1986 | Minnebraker | 280/250.1 |
| 2,771,939 | 11/1956 | Trubitt | 297/219 |
| 3,308,490 | 3/1967 | Cacioppo | 297/DIG. 6 X |
| 3,695,690 | 10/1972 | Carson | 297/219 X |
| 4,405,142 | 9/1983 | Whetstine | 280/250.1 |
| 4,426,113 | 1/1984 | Schutz | 297/219 |
| 4,632,450 | 12/1986 | Holdt | 297/DIG. 4 X |
| 4,691,962 | 9/1987 | Holdt | 297/DIG. 4 X |
| 4,693,289 | 9/1987 | Taylor et al. | 280/304.1 X |
| 4,718,721 | 1/1988 | Pompa | 297/224 X |
| 4,863,181 | 9/1989 | Howle | 280/250.1 |
| 5,007,676 | 4/1991 | Lien | 297/DIG. 6 X |
| 5,023,125 | 6/1991 | Gray | 297/DIG. 6 X |

*Primary Examiner*—Charles A. Marmor
*Assistant Examiner*—Kevin Hurley
*Attorney, Agent, or Firm*—Fay, Sharpe, Beall, Fagan, Minnich & McKee

[57] ABSTRACT

The present invention is directed to a slip cover for a wheelchair. The wheelchair includes a seat back which has a front and rear surface as well as first and second vertical posts disposed substantially parallel to each other between the front and rear surfaces. The vertical posts terminate at a substantially horizontally disposed upper side. The wheelchair slip cover includes an elongated member having an anterior portion that is received over the front surface of the seat back, and a posterior portion received over the rear surface of the seat back. The anterior and posterior portions merge at an intermediate portion which is received over the upper side of the seat back. A first connecting member extends from the elongated member and is wrappingly received about the first post of the seat back. A second connecting member also extends from the elongated member, and is wrappingly received about the second post of the seat back.

13 Claims, 7 Drawing Sheets

SLIP COVERS FOR WHEELCHAIRS

BACKGROUND OF THE INVENTION

This invention pertains to the art of invalid care devices, and more particularly to wheelchairs.

The invention is especially applicable to slip covers for wheelchair seats, seat cushions and seat backs, and will be described with particular reference thereto. It will be appreciated, however, that the invention has broader applications and can be advantageously employed in other environments. For example, the slip covers can be used in association with other types of seats, regardless of whether they are specifically designed for invalid care.

Wheelchairs are owned by a variety of entities in varying quantities. Hospitals and nursing homes own vast numbers of wheelchairs for use by countless numbers of people. Also, individuals whose physical condition so requires often own wheelchairs for permanent use. These people depend on the same wheelchair over prolonged periods of weeks, months or years.

Wheelchairs which are used by multiple parties (such as those wheelchairs which are rented or used in an institution analogous to a hospital or nursing home) can often present sanitation problems. They must be thoroughly cleaned and sanitized between rentals or uses by various parties, and they must be periodically cleaned when used by a single person for a given extended duration.

Also, spills from food, medication, liquids or other types of materials should preferably be cleaned from wheelchair surfaces almost immediately as they occur to prevent patient discomfort as well as staining and lack of sanitation. Moreover, many patients suffer from incontinence, and this, too, leads to the frequent cleaning of wheelchair surfaces.

Aside from the cleanliness and sanitation problems discussed above, many wheelchairs lend themselves to lacking in aesthetics. For example, wheelchairs owned by institutions or rental agencies offer very little to please the eye. The seats, seat cushions and seat backs are often limited to a basic, bland or neutral color. Even those individuals who own their own chairs with customized upholstery are subject to grow weary of the monotony of day-to-day existence in the same chair.

It would be desirable to develop a simple, quick and economical way for maintaining wheelchairs at appropriate levels of sanitation and cleanliness.

It would be further desirable to develop a simple, economical way to individualize or cosmetically change the appearance of rented, institutional or individually-owned wheelchairs.

The present invention contemplates a new and improved apparatus which overcomes all of the above-referenced problems and others and provides a simple, economical way to both maintain sanitary conditions as well as provide for aesthetically or cosmetically individualized wheelchairs.

BRIEF DESCRIPTION OF THE INVENTION

In accordance with the present invention, there is provided a cover designed specifically for wheelchairs.

In accordance with a more limited aspect of the invention, there is provided a slip cover for a wheelchair. The wheelchair itself includes a seat back which has front and rear surfaces as well as first and second vertical sides disposed substantially parallel to each other between the front and rear surfaces. The vertical sides terminate at a substantially horizontally disposed upper side.

The wheelchair slip cover includes an elongated member having an anterior portion that is received over the front surface of the seat back, and a posterior portion received over the rear surface of the seat back. The anterior and posterior portions merge at an intermediate portion which is received over the upper side of the seat back. A first connecting member extends from the elongated member and is wrappingly received about the first side of the seat back. A second connecting member also extends from the elongated member, and is wrappingly received about the second side of the seat back.

A principal advantage of the invention is that it provides a simple and economical way to establish clean and sanitary conditions for wheelchairs.

Another advantage of the present invention is that it suits the aesthetic needs and desires of individuals confined to a wheelchair. The individuals can economically change the color or design of their chair without buying a new chair. The chair can be personalized to the tastes of children, teenagers and adults.

Yet another advantage of the present invention is that it is not complicated to mount the slip cover on a wheelchair and to remove it therefrom. The cover can be removed and cleaned for further use, or disposed. While the cover is being cleaned, a different cover can be applied to the chair.

Still other advantages and benefits of the invention will become apparent to those skilled in the art upon a reading and understanding of the following detailed description.

BRIEF DESCRIPTION OF DRAWINGS

The invention may take physical form in certain parts and arrangements of parts, a preferred embodiment which will be described in detail in this specification and illustrated in the accompanying drawings which form a part hereof.

DETAILED DESCRIPTION OF THE PREFERRED EMBODIMENT

Figure 1:
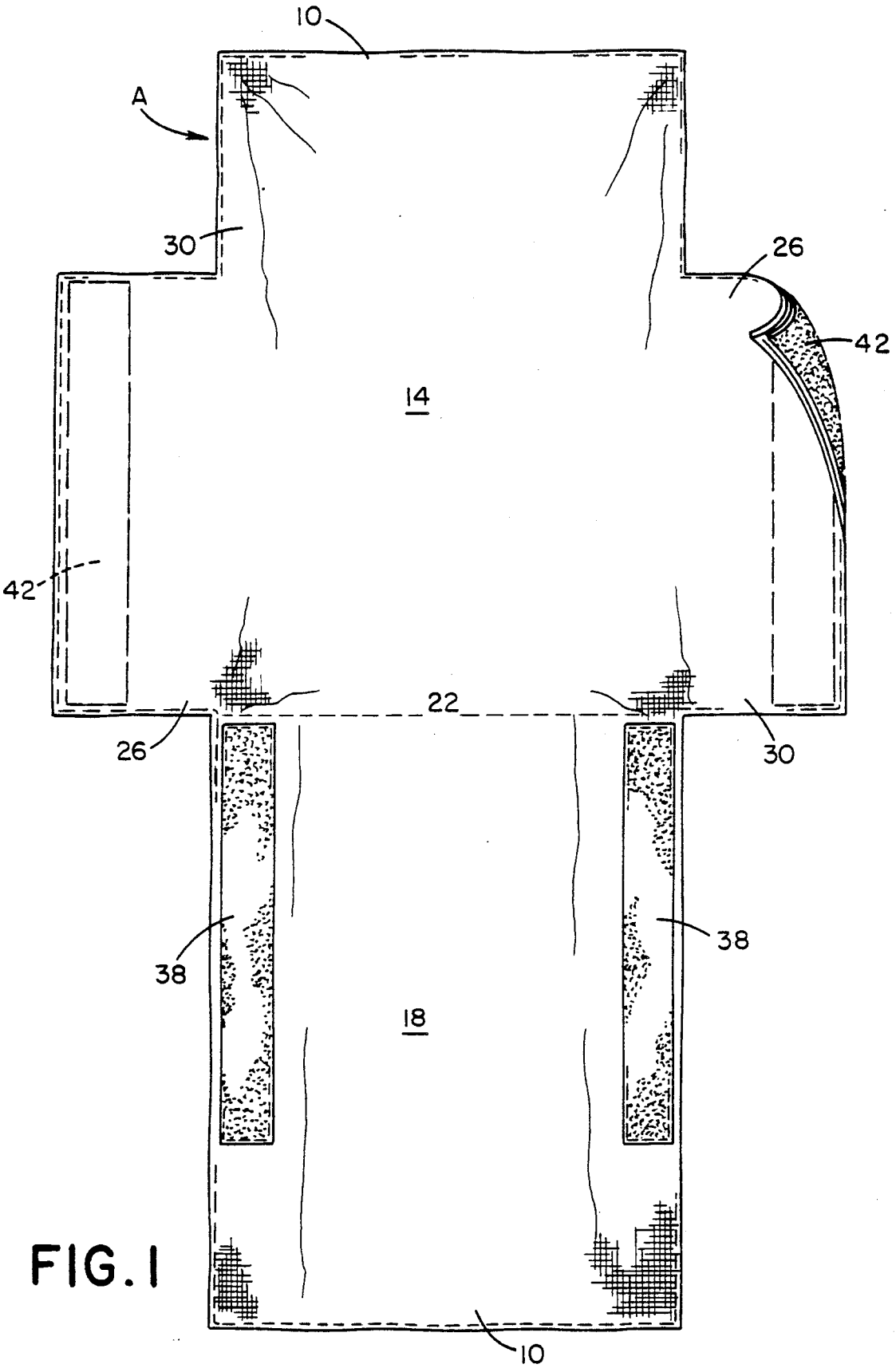
FIG. 1 is a plan view of a slip cover suited for use in association with a wheelchair seat back.
Figure 2:
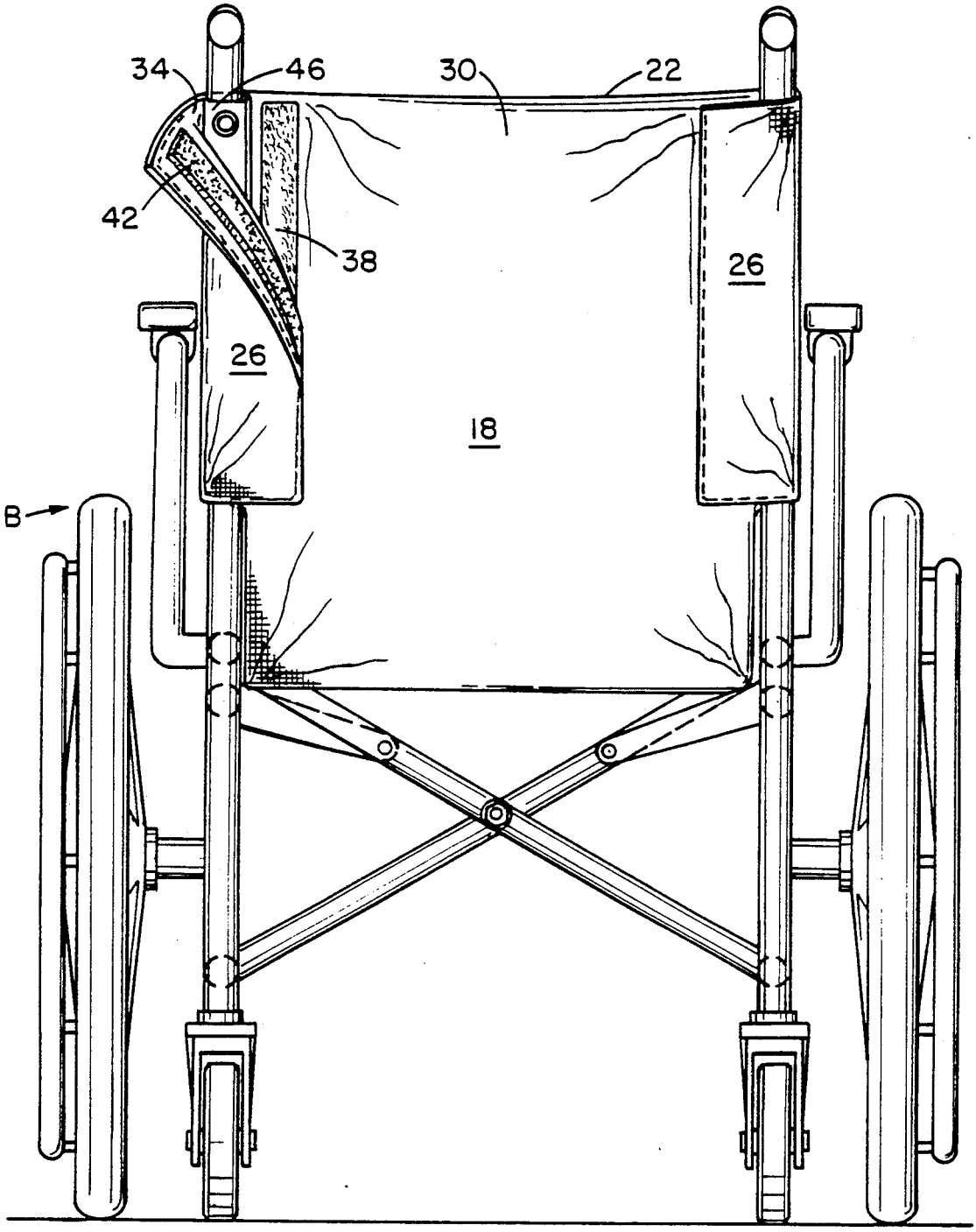
FIG. 2 is a rear elevational view of a wheelchair showing the slip cover of FIG. 1 mounted on the wheelchair seat back.

Referring now to the drawings wherein the showings are for purposes of illustrating the preferred embodiment of the invention only and not for purposes of limiting the same, FIG. 1 shows a seat back cover A which is adapted to be mounted on a wheelchair shown generally as B in FIG. 2. The seat back cover A has an overall T-shaped configuration. The main body of the seat back cover is an elongated, substantially rectangular member 10 that includes an anterior portion 14 and a posterior portion 18. The anterior portion and the posterior portion merge at a central or intermediate portion 22. FIG. 1 shows a dotted line traversing the elongated member 10 at the intermediate portion 22. The dotted line substantially indicates where the seat back cover A is folded or bent when it is mounted on wheelchair B.

The seat back cover further includes first and second flaps or connecting members or attaching members 26. These connecting members are coplanar with the elongated member 10 and extend from opposing side borders of the anterior portion 14.

Figure 3:
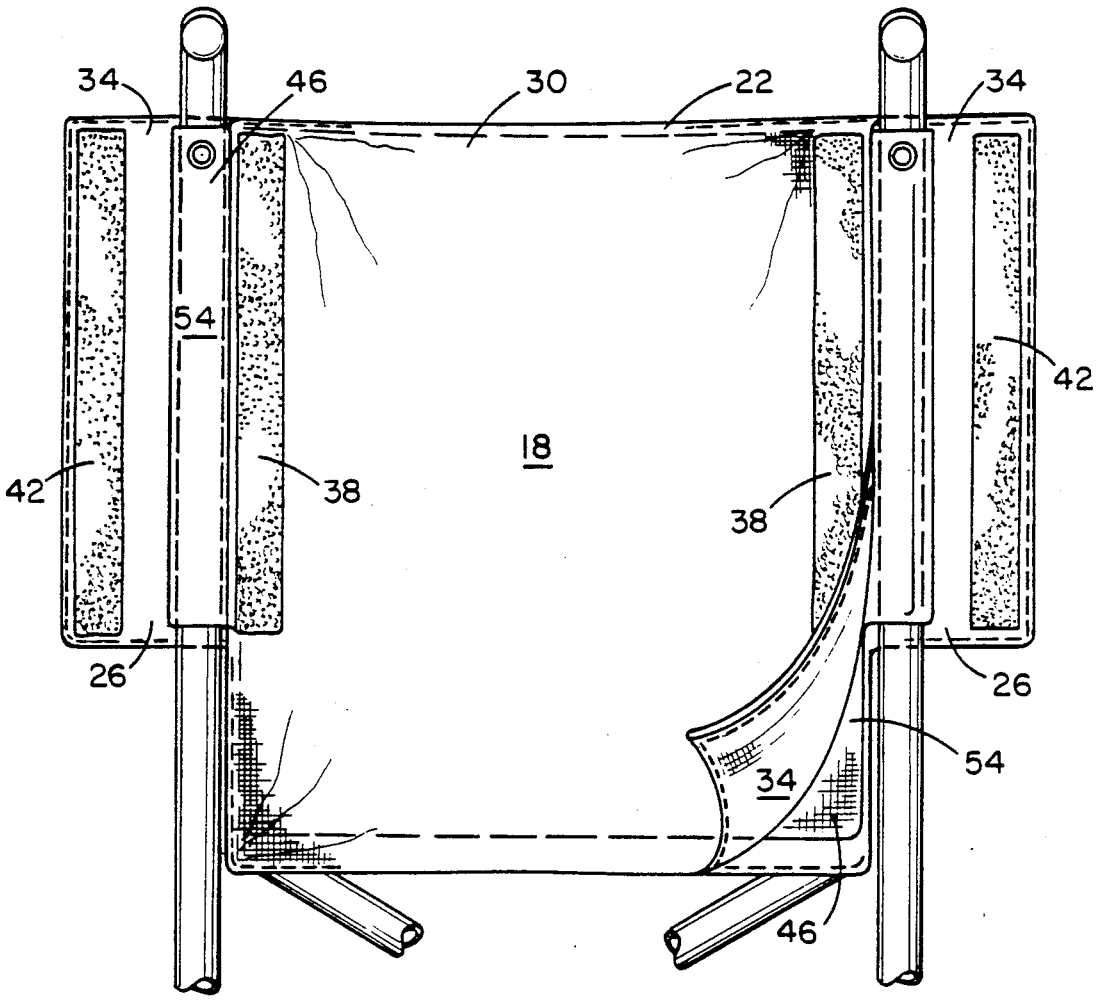
FIG. 3 is a rear elevational view of a portion of a wheelchair which shows the slip cover of FIG. 1 partially mounted on a wheelchair seat back.

The seat back cover A has an outer surface 30 and an inner surface 34 as shown in FIGS. 2 and 3. Hook and loop type fasteners are sewn directly onto the outer and inner surfaces of the material which comprises the seat back cover. Elongated strips of hook-type fasteners 38 are sewn on the outer surface 30 adjacent the side borders of the posterior portion 18 of the elongated member 10. Elongated strips of loop-type fasteners 42 are sewn on the inner surface 34 of the seat back cover A adjacent outer edges of the respective connecting members 26. When the seat back cover A is properly mounted on a wheelchair seat back, it is intended that the connecting members are positioned so that loop-type fasteners 42 mate with hook-type fasteners 38. This is shown in FIGS. 2 and 3.

As will be noted in FIG. 3, the seat back cover A is adapted to essentially drape over a wheelchair seat back 46. Intermediate portion 22 rests on an upper surface of the seat back. Posterior portion 18 rests adjacent to a rear surface 54 of seat back 46. While not specifically shown in the FIGURES, anterior portion 14 is designed to rest adjacent a front surface 58 of seat back 46. A portion of front surface 58 is shown in FIG. 4.

Once seat back cover A is in place over seat back 46 as described above and displayed in FIGS. 2 and 3, connecting members 26 extend or are situated to wrap around the respective side posts of the wheelchair seat back 46. Connecting members 26 respectively form layered regions on the posterior portion 18. The loop-type fasteners 42 which are present on the inner surface of the connecting members 26 matingly join with the hook-type fasteners 38 present on the outer surface of the posterior portion 18. FIG. 2 shows the seat back cover positioned into place on a wheelchair seat back.

Figure 4:
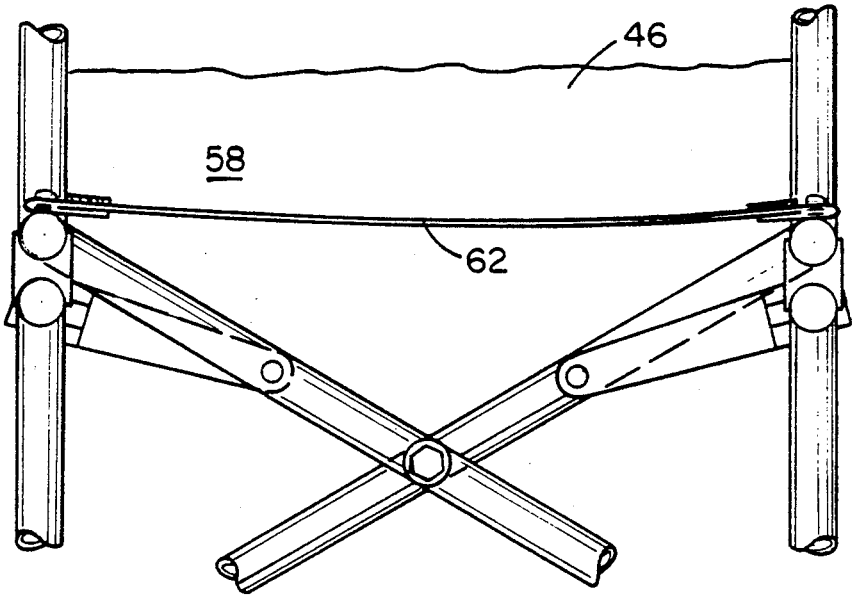
FIG. 4 shows a front elevational view of a wheelchair portion showing, in particular, a portion of the seat back and a front elevational view of a seat.
Figure 5:
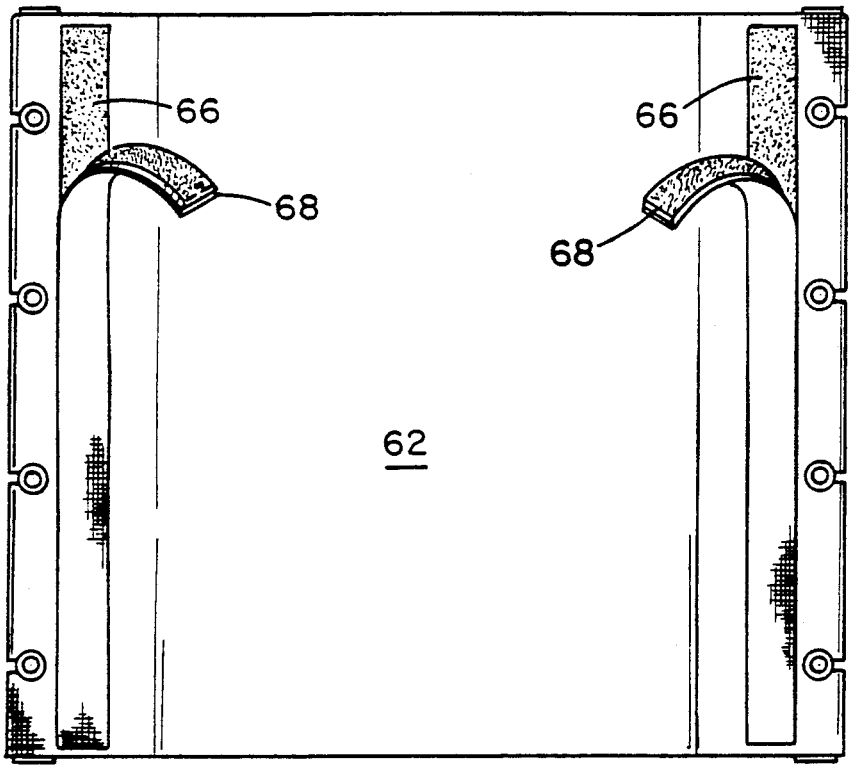
FIG. 5 is a plan view of a wheelchair seat.

Turning now to FIGS. 4 and 5, FIG. 4 shows a front elevational view of a portion of a wheelchair. Specifically, front surface 58 of seat back 46 is partially shown, along with a front elevational view of a seat 62.

FIG. 5 shows a top plan view of wheelchair seat 62. Elongated strips of hook-type fastener 66 are shown in parallel relation to one another on the top surface of seat 62. Protective strips 68, having loop-type fasteners affixed thereto, are situated for placement over the hook fasteners 66. When the seat is not used with a cover or cushion, the protective strips are placed over the hook fastener strips 66.

Figure 6:
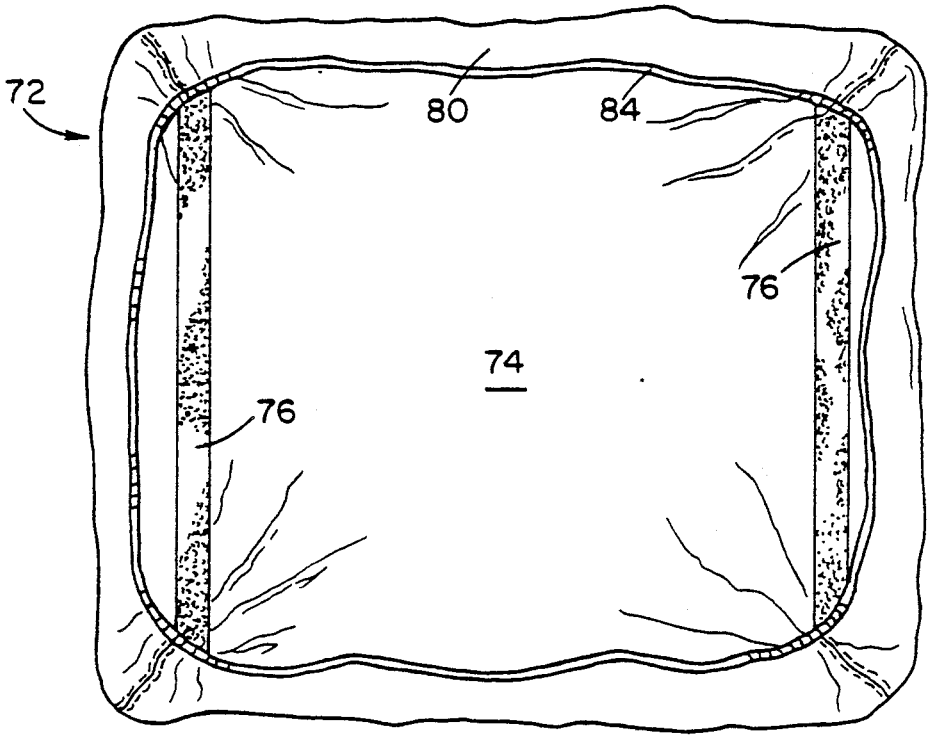
FIG. 6 is a bottom elevational view of a seat cover in accordance with the present invention.
Figure 7:
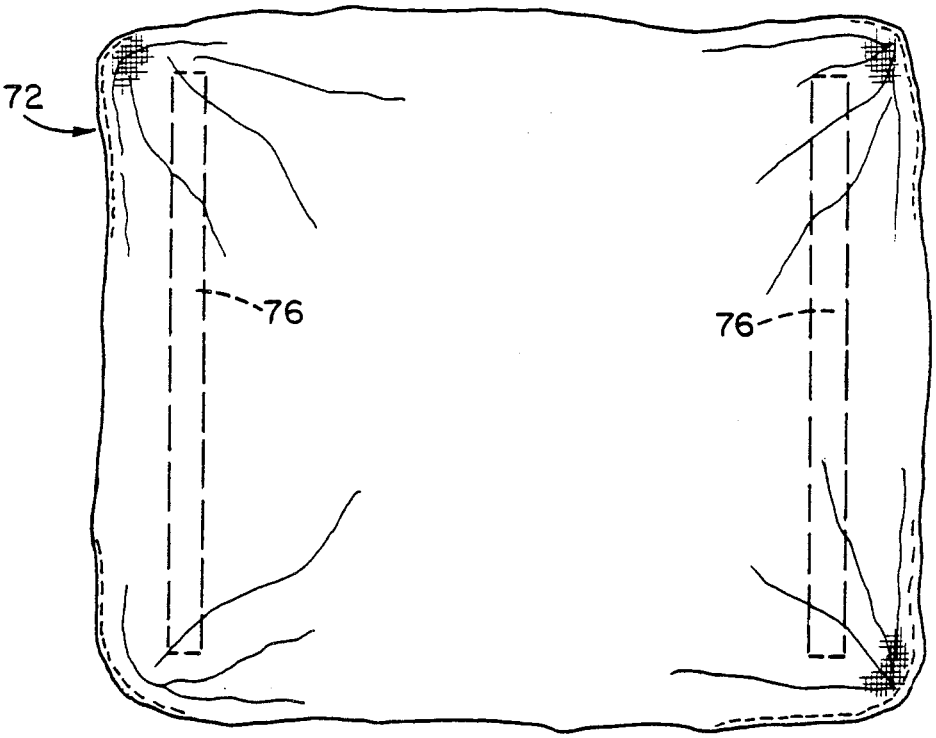
FIG. 7 is a top plan view of the seat cover shown in FIG. 6.
Figure 8:
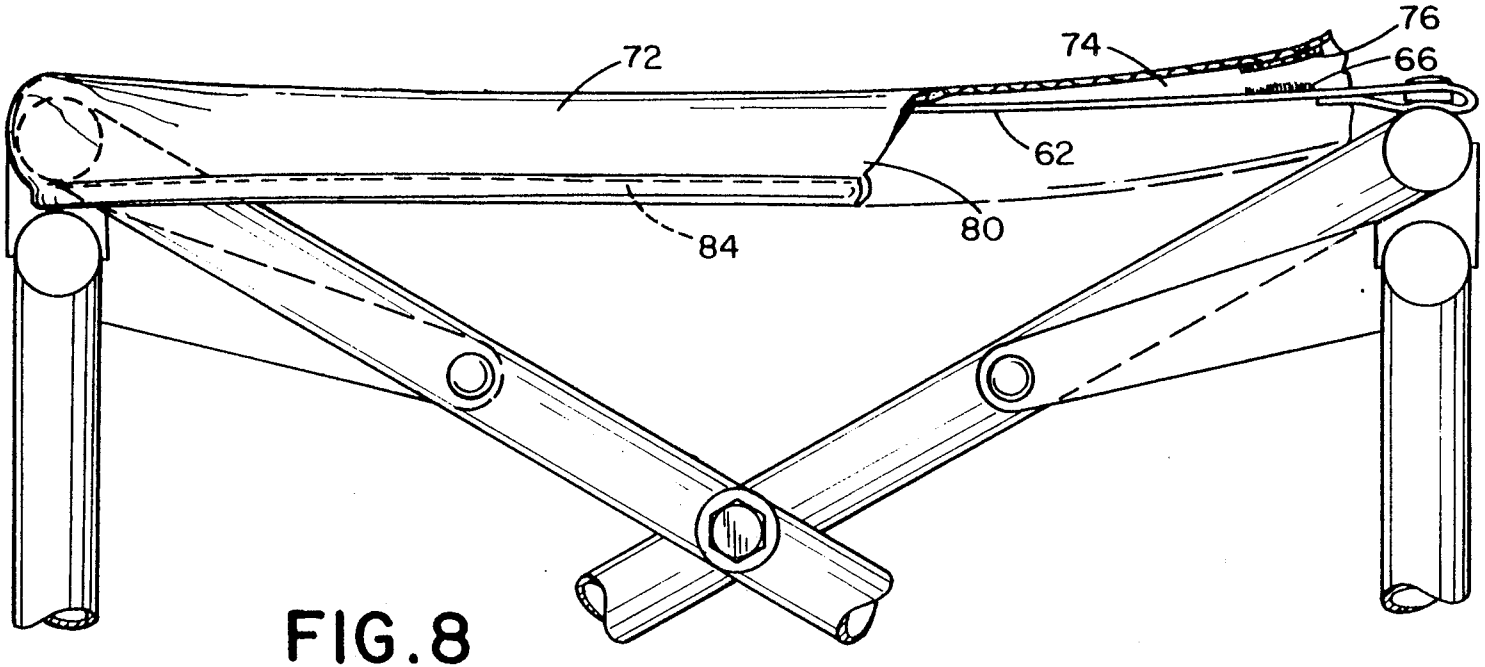
FIG. 8 is a front elevational view of a seat cover mounted on a seat, a portion of the cover being broken away to show details of the seat cover.

The present invention further contemplates a slip cover for the seat shown in FIGS. 4 and 5. This seat slip cover 72 is illustrated in FIGS. 6, 7 and 8. The material from which the seat slip cover 72 is fashioned can be the same as the material from which the seat back cover A is formed. An inner surface 74 of the seat slip cover includes parallel strips of loop-type fastener 76 suited for mating receipt with the hook fasteners 66 shown on seat 62. The seat slip cover 72 is designed to blanket over a top surface of seat 62 such that the top surface of the seat is concealed from ordinary observation. The inner surface 74 of the seat cover is in facing relationship with the seat 62 when the cover 72 is properly positioned in place on the seat. FIG. 8 offers a partially cut-away view showing the cover in place on the seat 62.

Seat cover 72 is shaped in a generally rectangular configuration. The edges of the rectangular portion gently bend back under in the direction of the inner surface of the seat cover to form a rim portion 80 which is suited for receipt under seat 62. The rim portion serves to maintain the cover in position on the seat. A band of elastic 84 is present at the perimeter or inward edge of the rim 80 to assist in mounting of the seat cover on the seat 62, as well as removing the cover therefrom. The elastic also serves to supplement the hook and loop type fasteners 66 and 76 in maintaining the seat cover on the seat.

Figure 9:
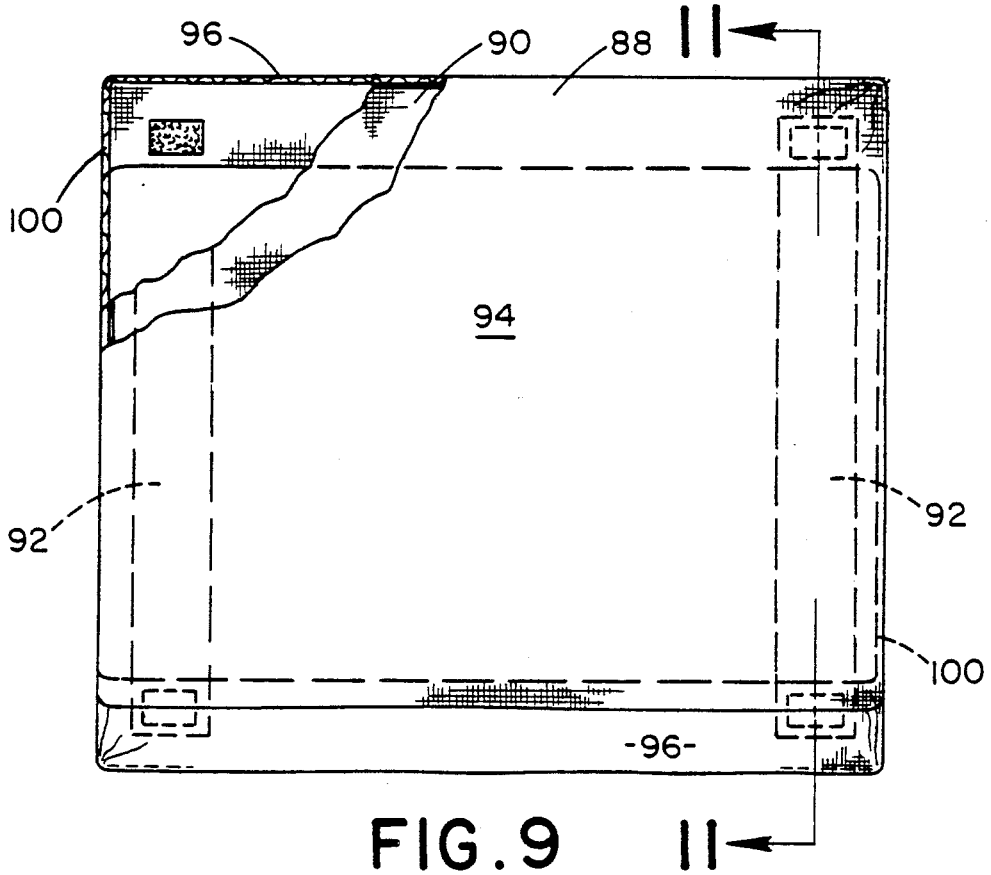
FIG. 9 shows a plan view of a wheelchair seat cushion cover mounted on a seat cushion, a portion of the seat cushion cover and seat cushion broken away to show details of the cushion cover.
Figure 10:
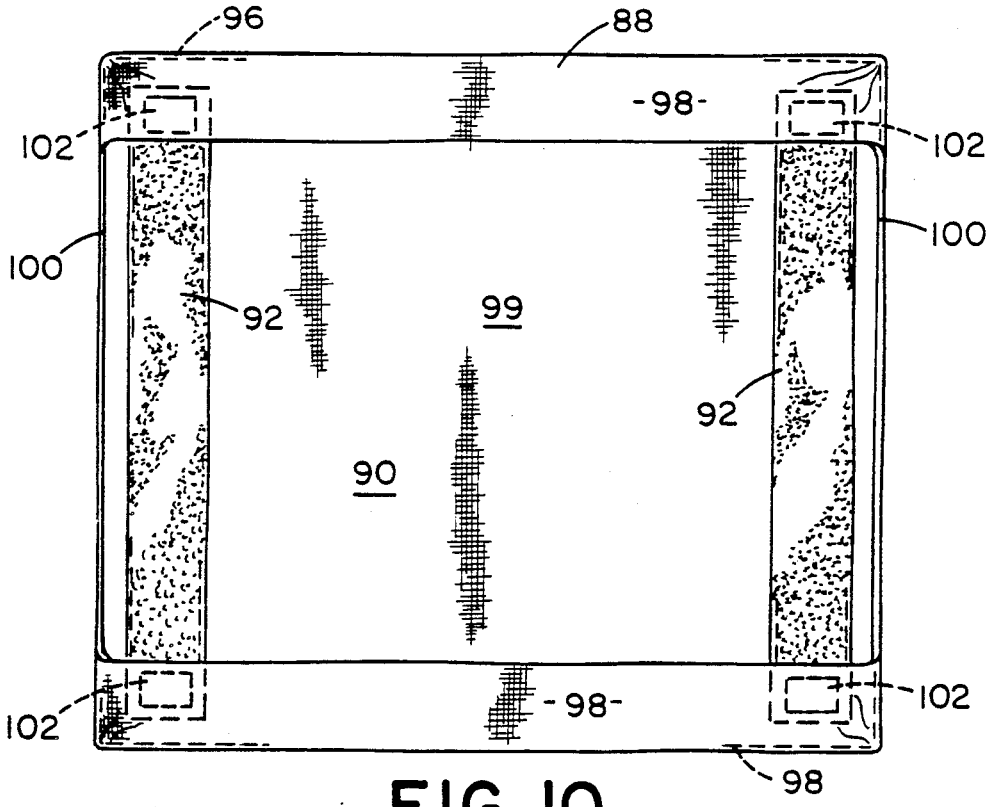
FIG. 10 is a bottom plan view of the wheelchair seat cushion cover mounted on a seat cushion.
Figure 11:
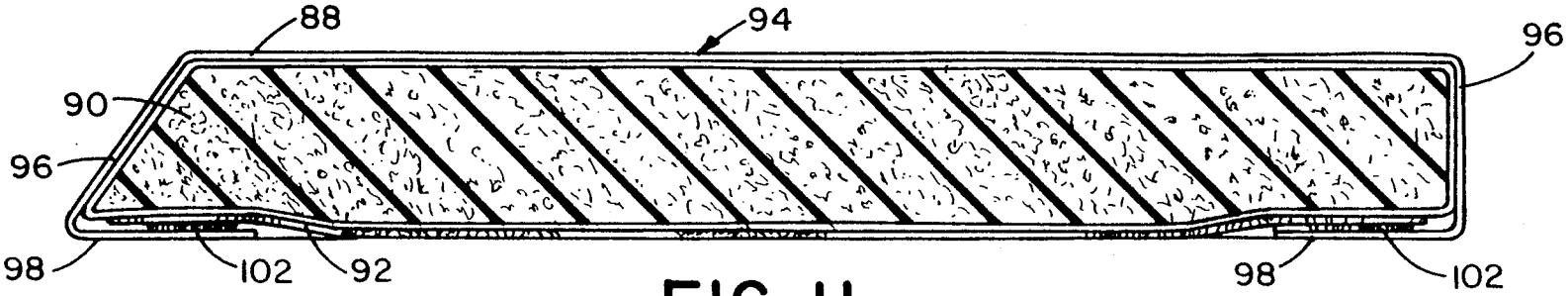
FIG. 11 is a side elevational view taken along line 11—11 of FIG. 9.

With attention now directed to FIGS. 9–11, a seat cushion cover 88 adapted for covering seat cushion 90 is shown. Seat cushion 90 includes parallel elongated strips of loop-type fasteners 92 which are designed and intended to mate with the hook fasteners 66 present on seat 62. Seat cushion cover 88 includes a substantially rectangular main body 94 suited for receipt over a top surface of seat cushion 90. Front and rear edges 96 of cushion cover main body 94 extend to gently fold down and under to provide covering receipt over front and rear sides of cushion 90. Holding portions 98 of cover 88 extend from the front and rear edges 96 to be received over a portion of a bottom side 99 of the cushion. Left and right sides 100 of the cushion cover also extend to cover the respective left and right sides of the cushion 90. Small segments of hook fastener 102 are affixed on an inner surface of the seat cushion cover holding portions 98. These fasteners 102 are situated to mate with corresponding segments of the cushion's loop-type fasteners 92.

FIG. 11 shows a cross section of a seat cushion cover 88 received on a seat cushion 90. The cushion's loop type fasteners 92 are situated to be matingly joined to the seat's hook fasteners 66, with the exception of the small segments which are mated with the squares of hook fasteners 102 attached to cover 88. As will be noted, the cushion cover 88 is positioned over the top of the cushion 90 and along the sides thereof to reach under the cushion. Hook fasteners 102 mate with the loop fasteners 92 present on the cushion as shown.

It is recommended that the material used in forming slip covers, namely, the seat back cover A, the seat cover 72 and cushion cover 88, be waterproof. A waterproof lining is also suggested. As such, the wheelchair itself will be protected against damage from spills or incontinence problems.

It is further suggested that the covers be comprised of a washable material which will allow for periodic cleanings and reuse of the covers. Conversely, the slip covers can be disposable.

Finally, for safety and regulatory reasons, the slip covers should be fireproof.

It is noted that the FIGURES as well as the above discussion teach the use of hook and loop type fasteners in association with the various slip covers and relevant wheelchair parts. The slip covers, however, are not limited to being fastened by hook and loop type fasteners, but can also be secured by many other types of fasteners including but not limited to, individual hooks and eyes, snaps, buttons, adhesives or zippers. Also, it is fully within the scope of this invention to substitute hook for loop and loop for hook type fasteners throughout the specification.

The invention has been described with reference to the preferred embodiment. Obviously, modifications and alterations will occur to others upon a reading and understanding of this specification. It is intended to include all such modifications and alterations insofar as they come within the scope of the appended claims or the equivalents thereof.

Having thus described our invention, we claim:

1. An apparatus, comprising:

a wheelchair including:

a seat back having a front surface and a rear surface joined by a first side and a second side, and first and second vertical posts disposed substantially parallel to each other adjacent the front and rear surfaces and terminating at a substantially horizontally disposed upper side; and a cover including:

an elongated member having an anterior portion received over the front surface of the seat back and a posterior portion received over the rear surface of the seat back, the anterior and posterior portions merging at an intermediate portion received over the upper side of the seat back;

a first connecting member extending from the elongated member and wrappingly received about the first side of the seat back for fastening receipt on said elongated member; and a second connecting member extending from the elongated member and wrappingly received about the second side of the seat back for fastening receipt on said elongated member independent of said first connecting member.

2. An apparatus, as set forth in claim 1, further including fastening means associated with the first and second connecting members for securing the cover into place over the wheelchair seat back.

3. An apparatus, as set forth in claim 2, wherein the fastening means comprises a system of hook and loop type fasteners received on an inner surface of the connecting members and an outer surface of the elongated member.

4. An apparatus, as set forth in claim 1, wherein the wheelchair further includes a seat member having a top surface and a bottom surface such that the top surface includes first fastening members thereon; and a seat cover member received over the entire top surface of the seat member and a portion of the bottom surface of the seat member, a perimeter of the seat cover member that is received over the bottom surface of the seat member being elasticized to allow for selective removal of the seat cover member from the seat member, said seat cover member having an inner surface including second fastening members for mating with said first fastening members.

5. An apparatus, comprising:

a wheelchair including a seat back having a front surface and a rear surface joined by a first side and a second side, and first and second vertical posts disposed substantially parallel to each other adjacent the front and rear surfaces and terminating at a substantially horizontally disposed upper side wherein the wheelchair further includes a removable cushion member having hook or loop type fasteners present thereon;

a cover including an elongated member having an anterior portion received over the front surface of the seat back and a posterior portion received over the rear surface of the seat back, the anterior and posterior portions merging at an intermediate portion received over the upper side of the seat back;

a first connecting member extending from the elongated member and wrappingly received about the first side of the seat back;

a second connecting member extending from the elongated member and wrappingly received about the second side of the seat back; and a cushion cover received on the cushion, the cushion cover having hook or loop type fasteners associated therewith and suited for mating receipt with the hook or loop type fasteners present on the cushion, the cushion cover being selectively maintained on the cushion.

6. A cover for a wheelchair, the wheelchair including a seat back having a front surface, a rear surface, and first and second vertical sides disposed substantially parallel to each other between the front and rear surfaces and terminating at a substantially horizontally disposed upper side, the cover comprising:

an elongated member having an anterior portion adapted for receipt over the front surface of the seat back and a posterior portion adapted for receipt over the rear surface of the seat back, the anterior and posterior portions merging at an intermediate portion adapted for receipt over the upper side of the seat back;

a first connecting member extending from the elongated member and adapted for wrapping receipt about the first vertical side of the seat back and fastening on the elongated member; and a second connecting member extending from the elongated member and adapted for wrapping receipt about the second vertical side of the seat back and fastening on the elongated member independent of the first connecting member.

7. A cover for a wheelchair, as set forth in claim 6, further including fastening means associated with the first and second connecting members and the elongated member for securing the cover into place over the wheelchair seat back.

8. A cover for a wheelchair, as set forth in claim 7, wherein the fastening means comprises a system of hook and loop type fasteners received on an inner surface of the connecting members and an outer surface of the elongated member.

9. A cover for a wheelchair, as set forth in claim 6, wherein the first and second connecting members extend from opposing side borders of the anterior portion of the elongated member and are suited for independent fastening receipt on an outer surface of the posterior portion of the elongated member.

10. A cover for a wheelchair, as set forth in claim 6, wherein the first connecting member is further adapted to extend beyond and around the first side to form a first layered region on a first segment of the posterior portion, and the second connecting member is further adapted to extend beyond and around the second side to form a second layered region on a second segment of the posterior portion.

11. A method for mounting a slip cover on a wheelchair having a seat back including a front surface, a rear surface, and first and second vertical sides disposed substantially parallel to each other between the front and rear surfaces and terminating at a substantially horizontally disposed upper side, comprising the steps of:

providing a slip cover having an elongated member including an anterior portion and a posterior portion merging at an intermediate portion, and first and second attaching members extending from opposing side borders of the anterior portion;

positioning the intermediate portion of the slip cover on the upper side of the wheelchair seat back so that the anterior portion of the slip cover is over the front surface of the seat back, and the posterior portion of the slip cover is over the rear surface of the seat back;

wrapping the first attaching member of the slip cover about the first vertical side of the wheelchair seat back; and wrapping the second attaching member of the slip cover about the second vertical side of the wheelchair seat back.

12. A method for mounting a slip cove ron a wheelchair, as set forth in claim 11, including the additional steps of:

fastening the first attaching member to the posterior portion of the elongated member by mating a first set of fastening means associated with the first attaching member to first corresponding mating means on the posterior portion; and fastening the second attaching member to the posterior portion of the elongated member by mating a second set of fastening means associated with the second attaching member to second corresponding mating means on the posterior portion.

13. A method for mounting a slip cover on a wheelchair, as set forth in claim 12, wherein the first and second sets of fastening means and corresponding fastening means include hook and loop type fasteners.

* * * * *